US010383418B2

(12) United States Patent
Sabie

(10) Patent No.: US 10,383,418 B2
(45) Date of Patent: Aug. 20, 2019

(54) SPECTACLE CASE

(71) Applicant: Razvan Sabie, Bucharest (RO)

(72) Inventor: Razvan Sabie, Bucharest (RO)

( * ) Notice: Subject to any disclaimer, the term of this patent is extended or adjusted under 35 U.S.C. 154(b) by 141 days.

(21) Appl. No.: 15/507,995

(22) PCT Filed: Aug. 20, 2015

(86) PCT No.: PCT/RO2015/000021
§ 371 (c)(1),
(2) Date: Mar. 1, 2017

(87) PCT Pub. No.: WO2016/043612
PCT Pub. Date: Mar. 24, 2016

(65) Prior Publication Data

US 2017/0303656 A1 Oct. 26, 2017

(30) Foreign Application Priority Data

Sep. 1, 2014 (RO) ..... A 2014-00663

(51) Int. Cl.
*A45C 11/04* (2006.01)

(52) U.S. Cl.
CPC ..... *A45C 11/04* (2013.01); *A45F 2200/0541* (2013.01)

(58) Field of Classification Search
CPC ..... B42F 7/04; B42F 9/008; Y10S 248/902; A45F 2200/0541; A45C 11/04
(Continued)

(56) References Cited

U.S. PATENT DOCUMENTS 2,650,701 A * 9/1953 Parsell ..... A45C 11/043 206/5
2,710,685 A * 6/1955 Baratelli ..... A45C 11/04 206/5

(Continued)

FOREIGN PATENT DOCUMENTS

CN 201563815 U 9/2010
CN 203776309 U 8/2014

(Continued)

OTHER PUBLICATIONS

Romanian Search Report for Application No. 201400663, dated Oct. 3, 2015, 11 pages.

(Continued)

*Primary Examiner* — Mollie Impink
(74) *Attorney, Agent, or Firm* — Dennemeyer & Associates, LLC

(57) ABSTRACT

The invention relates to a spectacle case for the storage and protection of spectacles and lenses against pressure and abrasion. The spectacle case has a body, which may be constructed of either a flexible material, such as natural or synthetic leather, paper, textiles, plastic, or of a rigid material, such as metal or plastic. The body has generally rectangular front and rear faces with rounded corners, the faces being separated by a central rectangular area with fold lines; the rear face is provided with a central trapezoidal-shaped recess having a median opening. The front and rear faces are folded towards one another, to create the spectacle case, along the fold lines. The central rectangular surface of the rear face is then penetrated by an opening/closing spectacle case connector clamp

3 Claims, 5 Drawing Sheets

(58) Field of Classification Search
USPC ..... 206/5; 229/67.4; D3/266; 248/902
See application file for complete search history.

(56) References Cited

U.S. PATENT DOCUMENTS

| | | | | |
|---|---|---|---|---|
| 2,863,487 | A | 12/1958 | Shiner | |
| 2,918,959 | A | 12/1959 | Bloch | |
| 3,819,033 | A | 6/1974 | Hueber | |
| 4,000,810 | A | 1/1977 | Leblanc | |
| 5,949,517 | A | 9/1999 | Lindberg et al. | |
| 7,850,302 | B1 * | 12/2010 | Riazi | A45F 5/02 24/3.3 |

FOREIGN PATENT DOCUMENTS

| | | | | |
|---|---|---|---|---|
| FR | 2823426 | A1 | 10/2002 | |
| GB | 420114 | | 11/1934 | |
| WO | WO-2017068369 | A3 * | 5/2017 | A45C 11/00 |

OTHER PUBLICATIONS

International Search Report and Written Opinion for Application No. PCT/RO2015/000021, dated Feb. 10, 2016, 10 pages.

* cited by examiner

SPECTACLE CASE

CROSS-REFERENCE TO RELATED APPLICATIONS

This application is the U.S. national phase of PCT Application No. PCT/RO2015/000021 filed on Aug. 20, 2015, which claims priority to RO Patent Application No. a 2014 00663 filed on Sep. 1, 2014, the disclosures of which are incorporated in their entirety by reference herein.

TECHNICAL FIELD

The invention relates to an attachable case for eyeglasses or sunglasses.

BACKGROUND

It is known a spectacle case presented in the patent application FR2823426, which has the shape of a wallet with two sides, made of supple material such as leather or synthetic fabric or plastic material and rigid material such as a metallic or plastic material that folds over and is provided with on/off glasses hinges, and with a Velcro lock staple system, magnets, laces, zipper or elastic.

It is also known, a spectacle case presented in patent application GB420114, which has a rear and a front side made of sheet or a material that imitates the tortoise shell, which are set out, with curved edges, joined by a central rectangular surface, the rear side having the edge opposite to the central portion curved towards the outside to allow the insertion of the glasses, while the upper edge of the front side is bent perpendicularly on it, covering part of the space between the two sides, thus ensuring the maintenance of the glasses inside the case, the inner surface of the case being lined with a lens protection material, such as, for instance, velvet or any other soft material.

There is also known a spectacle case, as shown in U.S. Pat. No. 2,918,959, which has an outer casing in the form of glasses that has on the inside a metal flexible frame, made of a metal strip or spring steel wire, which keeps the glasses inside.

SUMMARY

The aim of the present invention is to provide a light, flexible spectacle case with a reduced size capable of protecting the glasses and its lenses against mechanical/mild shocks and abrasion.

The spectacle case, according to the invention, is made of a material body, which may be a flexible material, such as natural or synthetic leather, textile, plastic or a rigid material such as a metal or plastic material, the material body having a rectangular front side and a rear side, with rounded corners, separated by a central rectangular area and being folded towards one another by fold lines, the rear side being provided with a central trapezoidal recess, wherein the central rectangular surface is provided with a median opening penetrated by an opening/closing spectacle case clamp.

The spectacle case, according to the invention, has the advantage of a reduced size and increased flexibility, it can be kept in your pocket, around your neck or hip, or in any bag without inconveniences protecting the glasses against pressure and abrasion. Also, the spectacle case, according to the invention, attaches very simple on the glasses, it can be adjusted to the size of several types of glasses and it is very cheap to produce.

BRIEF DESCRIPTION OF THE DRAWINGS

We give below some embodiments of the invention, in connection with drawings 1 to 8, which represent.

DETAILED DESCRIPTION

Figure 1:
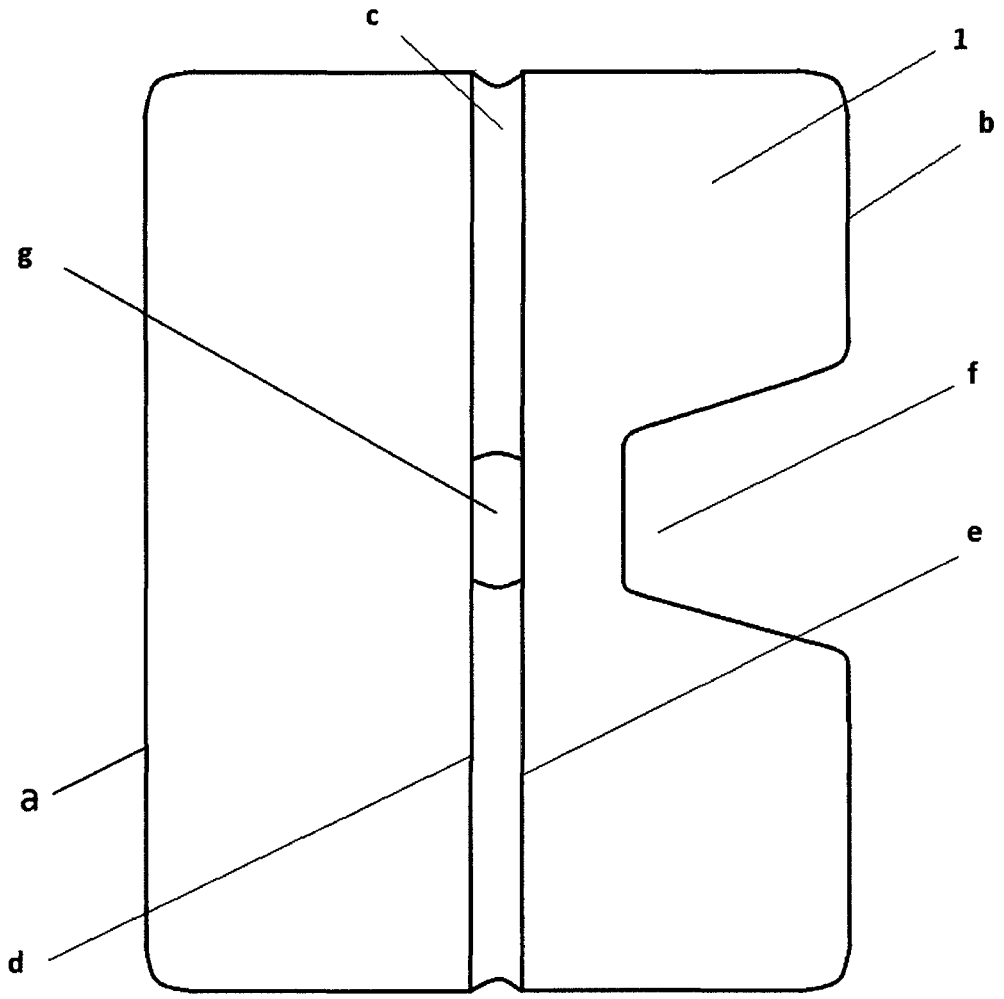
FIG. 1, exploded view of the spectacle case.
Figure 2:
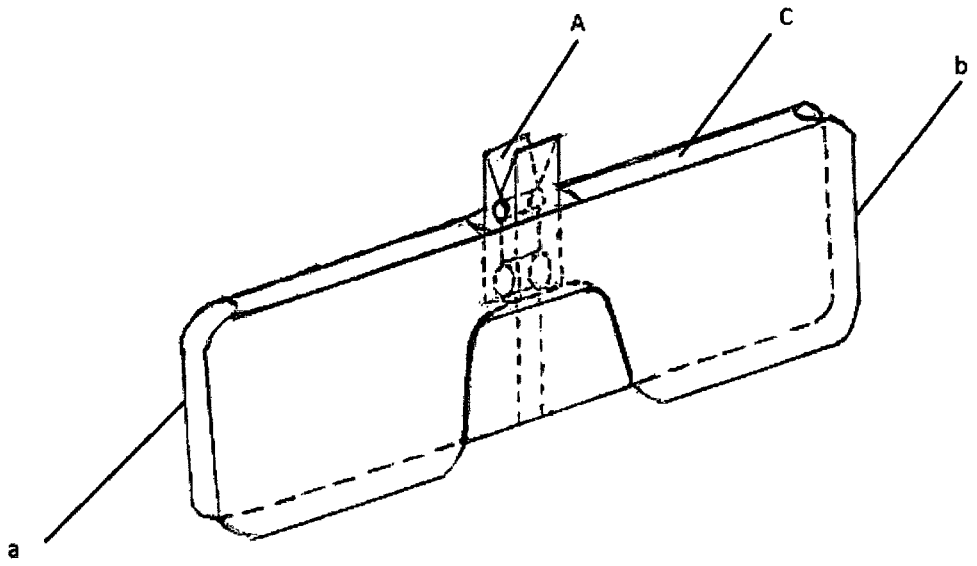
FIG. 2, general view of the spectacle case.
Figure 3:
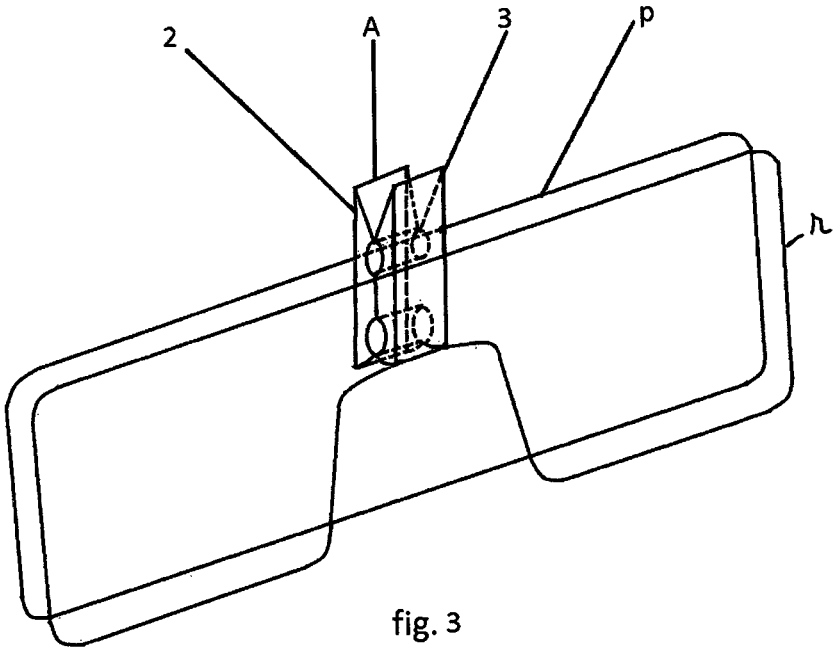
FIG. 3, overview of an alternative embodiment of the spectacle case.
Figure 4:
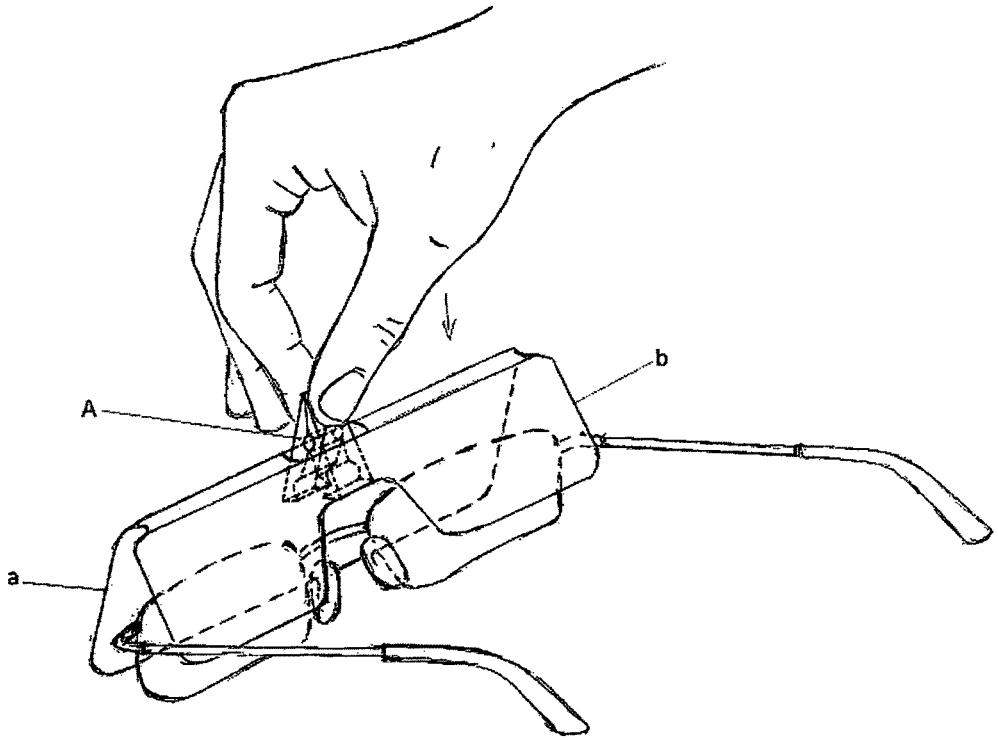
FIG. 4, shows how to attach the spectacle case to the spectacles.
Figure 5:
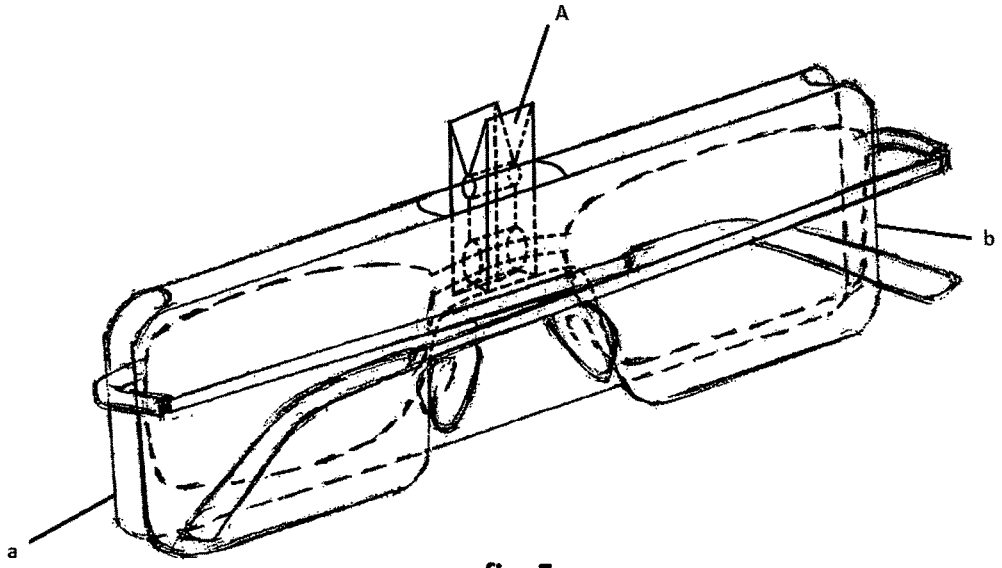
FIG. 5 view of the spectacle case with the glasses placed inside.
Figure 6:
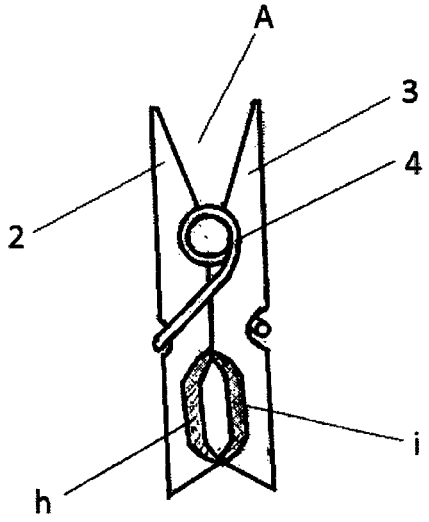
FIG. 6, side view of an opening/closing clamp of the spectacle case.
Figure 7:
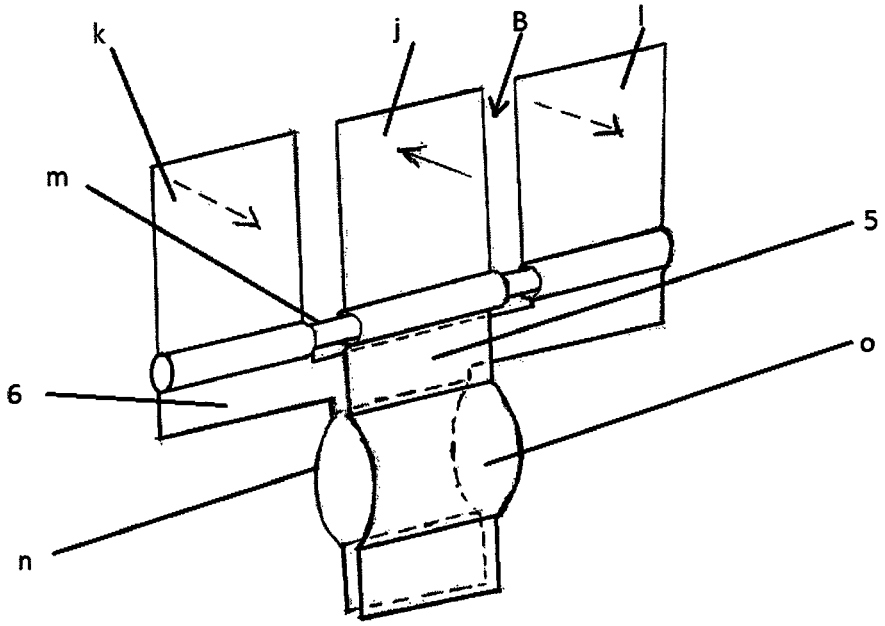
FIG. 7, side view of a version of the opening/closing clamp of the spectacle case.
Figure 8:
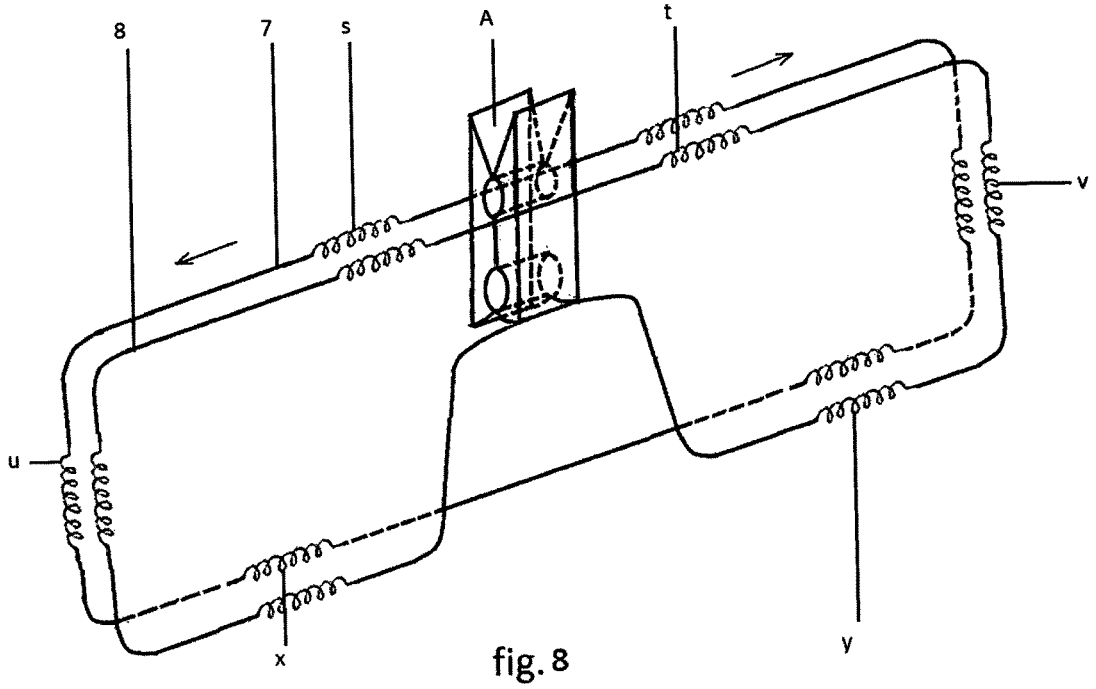
FIG. 8 is a partial view of the spectacle case fitted with expandable elastic frames on the opening/closing clamp.

The spectacle case, according to the invention, is made of a material body 1, which may be a flexible material, such as natural or synthetic leather, paper, textile or plastic material or a rigid material such as a metal or plastic material.

The material body 1 has a rectangular front side a and a rectangular rear side b, having rounded corners separated by a central rectangular surface c which are folded towards each other by fold lines d and e. When using a less rigid material, fold lines d and e, as well as the edges of sides a and b can be reinforced by hems and seams.

The rear face b can be provided with a central, trapezoidal recess f.

The central rectangular surface c is provided with a median opening g penetrated by an opening/closing spectacle case clamp A.

The opening/closing spectacle case clamp A is provided with similar side arms 2 and 3, coupled by means of a helical spring 4.

The side arms 2 and 3 are provided at the lower side with elongated similar recesses h and i, between which there is attached the frame portion located between the lenses of spectacles, and may be lined with a soft material, such as velvet, felt, rubber or other materials with similar properties to protect the spectacles frame. The clamp thus cushioned grip provides adequate and sufficient outlet for proper fixation of the case and at the same time safeguarding the spectacle frame in the clip area.

The side arms 2 and 3 of the opening/closing spectacle clamp A are fixed to the front side a respectively on the rear side b of the spectacle case in a manner known per se, such as, for example, by gluing.

In an alternative embodiment of the present invention an opening/closing spectacle case clamp B may be used, which has a front arm 5, provided with an upper actuating blade j, and with a rear arm 6, provided with similar actuating blades k and l, which are articulated on a central rod m.

The front arm 5 and the rear arm 6 above are provided at the bottom with similar elongated recesses n and o, between which the spectacles frame is attached and which are also lined with a soft material, such as for example velvet, velours, felt or rubber, for the protection of the spectacle frame.

In another alternative embodiment, the spectacle case is provided with a front side p and a rear side r, rectangular, independent, which have rounded corners and are fixed to the side arms 2 and 3 of the opening/closing spectacle case clamp A or on the front arm 5 and rear arm 6 of the opening/closing spectacle case clamp B.

In order to use the case according to the invention for different frame sizes of glasses, the rectangular front side a and rear side b, respectively the rectangular front side p and rear side r, independently, are made with a plurality of wrinkles and are attached to tensile frames 7 and 8, provided with helical portions s, t, u, v, x and y, which can be expanded/compressed according to the length and width of the spectacles.

It is desirable that the frame materials should have elastic properties in order to mold easier on the possible curvatures of spectacles, and after detaching the case, according to the invention, to return to its original shape with straight and parallel frames so it can be held without inconveniences in any pocket or other storage spaces.

The frames may also be made of materials with plastic properties, which retain their shape after deformation. This option may be appropriate for certain models of glasses with a more pronounced curvature, such as those for sunscreen, in case the user wishes to obtain a custom case for that model.

In order to attach the spectacle case to the spectacles, the side arms 2 and 3 of the clamp A are to be handled by pressing them with two fingers, or the actuating blade j and the actuating blades k and l of the clamp B, with three fingers, the rectangular front side a and rear side b, or the rectangular, independent front side p and the rear side r are to be removed, the glasses are to be inserted between them and then the side arms 2 and 3 of the clamp A or the actuating blades j, k and l of the clamp B are to be released and the spectacle case will be fixed on the glasses.

To remove the spectacle case the opposite procedure should be followed.

The invention claimed is:

1. A spectacle case which is made of a material body of a flexible material, including natural or synthetic leather, paper, textile or plastic material, or of a rigid material, including metal or plastic material, the material body having a front face and a rear face separated by a central rectangular area and being folded towards one another by fold lines, the front face having a rectangular shape, the rear face being provided with a central trapezoidal recess, characterized in that the central rectangular area is provided with a median opening penetrated by an opening/closing spectacle case clamp; and, wherein the opening/closing spectacle case clamp is provided with side arms having at a bottom some elongated recesses, the side arms being connected by a helical spring.

2. The spectacle case according to claim 1, wherein the side arms of the opening/closing spectacle case clamp are fixed on the front face and the rear face, respectively, of the spectacle case material body.

3. The spectacle case according to claim 1, wherein the opening/closing spectacle case clamp side arms have a front arm provided with an upper actuating blade, as well as a rear arm provided with an actuating blade, the blades articulate on a central rod.

* * * * *